US011697152B2

(12) United States Patent
Brown

(10) Patent No.: US 11,697,152 B2
(45) Date of Patent: Jul. 11, 2023

(54) VITRIFORMING—A METHOD FOR FORMING MATERIAL AT LIQUID TEMPERATURE WITHIN A VITREOUS FORMING MEDIUM

(71) Applicant: Bryan Kekst Brown, Philadelphia, PA (US)

(72) Inventor: Bryan Kekst Brown, Philadelphia, PA (US)

( * ) Notice: Subject to any disclaimer, the term of this patent is extended or adjusted under 35 U.S.C. 154(b) by 203 days.

(21) Appl. No.: 16/873,151

(22) Filed: Feb. 14, 2020

(65) Prior Publication Data

US 2021/0252588 A1 Aug. 19, 2021

(51) Int. Cl.

| | |
|---|---|
| ***B22D 23/00*** | (2006.01) |
| ***B22D 25/00*** | (2006.01) |
| ***B22D 25/02*** | (2006.01) |
| ***B22D 25/06*** | (2006.01) |

(52) U.S. Cl.

CPC ..... *B22D 23/00* (2013.01); *B22D 25/00* (2013.01); *B22D 25/02* (2013.01); *B22D 25/06* (2013.01)

(58) Field of Classification Search

CPC ..... B22D 23/00; B22D 25/00; B22D 25/02; B22D 25/06

See application file for complete search history.

(56) References Cited

U.S. PATENT DOCUMENTS

| | | | | |
|---|---|---|---|---|
| 2,979,424 | A | 4/1961 | Whitehurst | |
| 4,620,587 | A | 11/1986 | Potard | |
| 4,838,336 | A * | 6/1989 | Gray | G01N 1/125 164/4.1 |
| 5,236,033 | A * | 8/1993 | Goy | B22D 27/04 164/122.1 |
| 5,516,481 | A | 5/1996 | Ishizaki | |
| 6,143,070 | A | 11/2000 | Bliss | |
| 8,940,095 | B2 | 1/2015 | Dutta | |
| 9,364,890 | B2 | 6/2016 | Foltz, IV et al. | |
| 9,863,062 | B2 | 1/2018 | Swaminathan et al. | |
| 9,895,744 | B2 | 2/2018 | Tilak et al. | |
| 10,150,202 | B2 | 12/2018 | Waldrop, III et al. | |
| 2013/0206351 | A1 * | 8/2013 | Gruber | B22D 23/00 164/66.1 |

FOREIGN PATENT DOCUMENTS

EP 2238086 A2 10/2010

* cited by examiner

*Primary Examiner* — Kevin E Yoon

(57) ABSTRACT

Vitriforming is a method for forming material into complex geometries within a vitreous substance. Liquid material is formed inside the vitreous substance through external forces applied to the vitreous forming medium. This technique can be broken down into four categories of operations: encasement, setup, forming, and extraction. All operations involve a forming medium, and a workpiece. The workpiece can be composed of any material so long as the forming medium is temperature, viscosity, and chemically compatible. The vitreous forming medium translates outside forces into the workpiece to create various geometries. This forming medium can remain a part of the final assembly or get extracted after forming takes place. Workpiece geometry is affected by forming tool geometry, initial setup, heat, and material properties. This process can be used as a fast, efficient means of forming metal or other materials with unique abilities to control material combinations, surface chemistry, texture, and overall geometry.

16 Claims, 15 Drawing Sheets

VITRIFORMING—A METHOD FOR FORMING MATERIAL AT LIQUID TEMPERATURE WITHIN A VITREOUS FORMING MEDIUM

FIELD OF THE INVENTION

This invention relates to the forming of molten material with a finished product that is solid and comprised of specific geometry.

BACKGROUND OF THE INVENTION

The present invention relates to the forming of molten material within a vitreous forming medium. A glassy forming envelope is used to contain and impart geometry onto the workpiece.

This method allows for a forming environment that has chemically unique properties. The glassy forming medium can be used to extract contaminants, as well as provide specific chemistry to the surface of the material. This method is a fast, efficient means of obtaining specific geometry in a material. The forming material can be reused.

EP2238086A2
U.S. Pat. No. 2,979,424
U.S. Pat. No. 5,516,481
U.S. Pat. No. 9,457,396
U.S. Pat. No. 8,617,455
U.S. Pat. No. 9,475,119
U.S. Pat. No. 6,143,070
U.S. Pat. No. 4,620,587
U.S. Pat. No. 8,821,636

SUMMARY OF THE INVENTION

This technique allows for the continuous forming action of molten materials within a vitreous forming envelope, a unique chemical environment with precise temperature control.

The forming medium can be a part of the final assembly, allowing for unique material combinations and geometry not possible any other way. This combination of unique factors generates a direct, dependent relationship between the workpieces internal structure, its composition, and geometry.

BRIEF DESCRIPTION OF DRAWINGS

FIG. 2 depicts a 14 k gold forming blank inside of a 12 mm borosilicate glass tube.

DETAILED DESCRIPTION OF THE INVENTION

Figure 1:
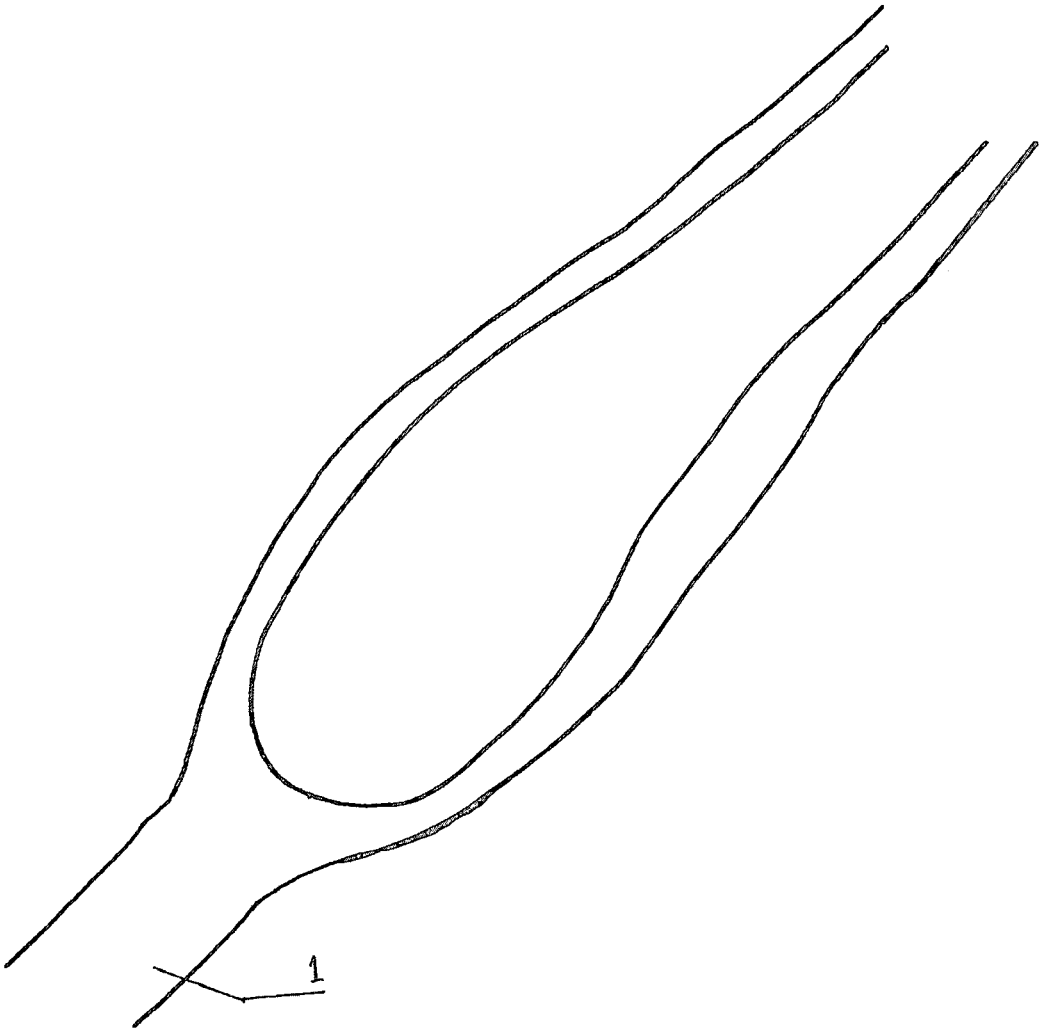
FIG. 1.—The "crucible" or the initial empty space within the vitreous material where the material to be formed is placed. Thickness can be predetermined to assist with the encasement or setup process. The example depicted is a 12 mm diameter and 2.2 mm thickness, borosilicate glass tube.

Vitriforming is a method for forming a molten material (A) within a vitreous material (B) encasement, allowing for the manipulation of both materials simultaneously. Material A is formed inside of the vitreous forming medium by way of external forces applied to material B. This technique can be broken down into four categories of operations: encasement, setup, forming, and extraction. Each category has its own parameters and specific concerns. All operations involve a workpiece (material A) and a forming medium (material B). The workpiece can be composed of any material that has a liquid phase.

The vitreous forming medium translates outside forces into the workpiece to create various geometries. An example is to pull or push on a glass membrane with an external tool such that the interior molten metal is influenced by this action, creating a unique geometry determined by viscosity and fluid dynamics. Through this forming method, the geometry of the workpiece and the internal structure can be generated/manipulated simultaneously and have a dependent relationship. This is achieved by the specific control of heat in relation to the forming geometry. In the case of metal, the crystal structure and boundaries are visible on the surface of the finished object. The surface cannot be achieved another way and is specific to this process. The qualities of this surface depends on the metal/alloy and its purity.

Various factors will determine whether a specific combination of materials will work with this process. The two most important material properties are the melting point of material A and the viscosity range of material B. The workpiece must be a liquid at the temperature that the forming medium becomes soft and malleable. For example, 24 k gold melts at 1948 degrees Fahrenheit. Gold forms well within borosilicate glass whose softening point is 1510 degrees Fahrenheit Wile there is a small window of temperature where the glass is beyond its softening point and the metal is still sold, the temperature range from 1948 to 2500 degrees Fahrenheit is the forming range. The viscosity of the forming medium and its ability to contain the molten metal will determine the top of the forming range. The viscosity of borosilicate glass at the melting temperature of gold is roughly 3 poises. At this temperature, the gold's viscosity is about 4.58 centipoises. This difference allows the glass to contain the molten metal while being able to be manipulated through outside force. There is a specific window of viscosity compatibility for each type of metal and glass. Different kinds of glasses with different viscosity/temperature ranges can be used for types of materials with different melting temperatures. The required forming medium viscosity for forming is between $10^{12}$ and $10^{1}$(Pa·s)

The composition of the glassy material and the workpiece can cause various chemical processes to occur. This can be planned and taken advantage of or prevented. Chemistry at the interface between the two materials can be affected by processing time, temperature, or physical manipulation to produce the desired outcome.

Successful Glass/Material Combinations
- Borosilicate Glass
  - Gold
    - 24 k
    - 14 k
    - 12 k
  - Silver
    - Fine Silver
    - Sterling Silver
    - Argentium
  - Copper
  - Bronze-Copper/Tin-90/10
  - Tin
  - Gallium
  - Aluminum
- Soda-Lime Glass
  - Tin
- Sugar
  - Milk Chocolate The four categories of operation for this technique are Encasement, Setup, Forming, and Extraction. Each category can be broken down into further operational steps, including optional alternative processes depending on the desired outcome. There are also circumstances where one or more of the categories can be combined or omitted, such as when a metal and glass are compatible and the finished object consists of a metal and glass assembly, extraction does not occur. The material must first be encased in a vitreous forming medium. At this point, the desired final workpiece geometry will determine the proper setup geometry and thickness. Once the vitriform is properly set up, the forming medium and workpiece must be heated both locally and globally to the required temperatures. The ideal temperature must be reached throughout the forming medium and workpiece before the forming operation can take place. The workpiece is formed to the final geometry through cycles of heating and forming using viscosity and various tools.

Figure 13:
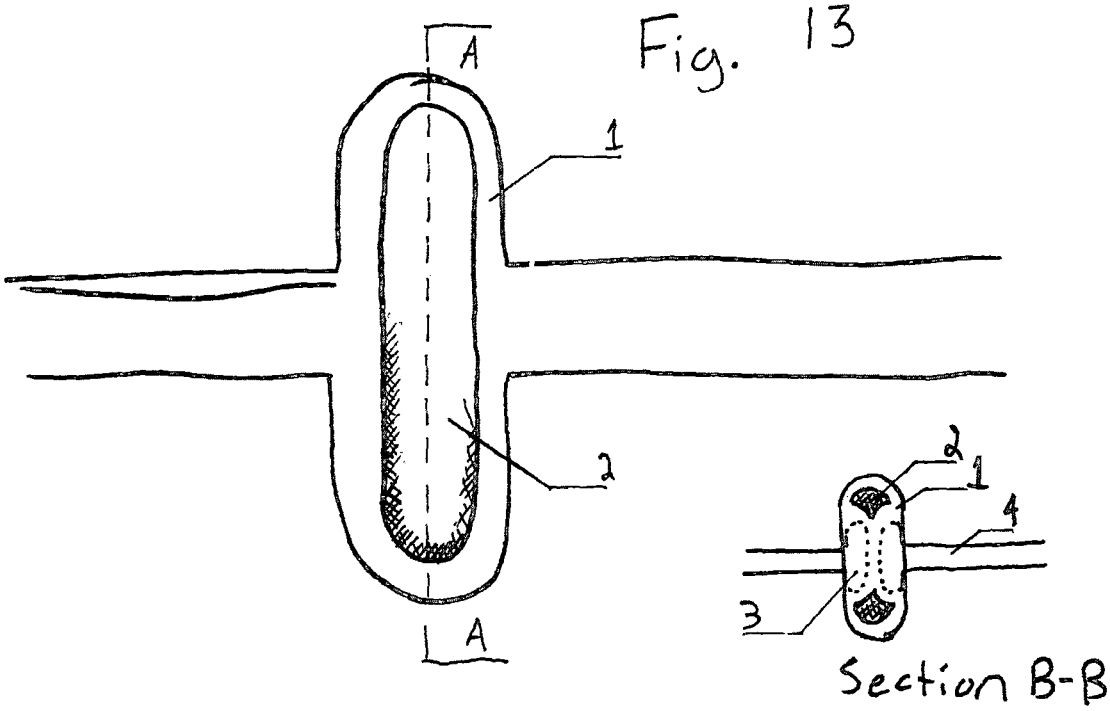
FIG. 13—Dissected view showing how tool geometry affects workpiece geometry. Subsequent to FIG. 10, as the discs of glass at lower temperatures are pushed through the center of the liquid metal, the inner surface of the ring reflects the shape of the tool and becomes concave.
Figure 13:
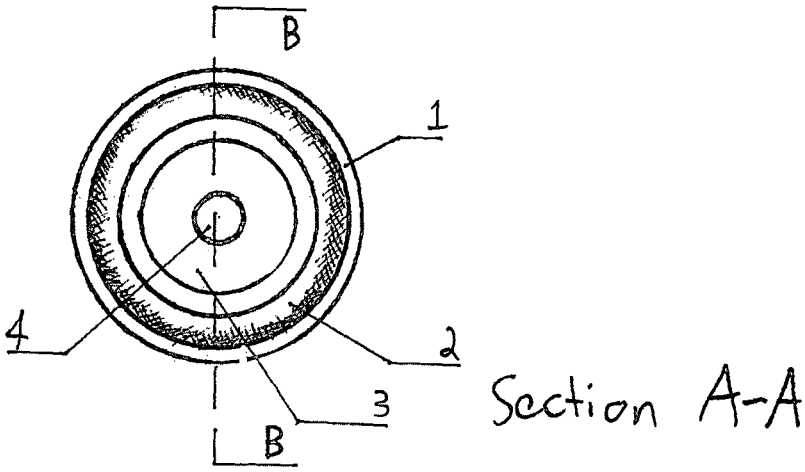

In one embodiment, the forming takes place using an oxygen-propane torch as the heat source. The borosilicate glass forming medium is held in two hands using glass rods as handles and is typically being spun so the material has an even effect from gravity. If the workpiece is conductive, an inductive heater can be used to provide heat that radiates from the workpiece, rather than through the forming medium. Typical tools include a graphite marver, tweezers, and glass rods that can be formed into more specifically shaped tools. More complicated and/or automated forming processes will significantly increase the forming capabilities of this method. The use of electrical and computer numerically controlled force generating instruments will increase the possible complexity, and repeatability of workpiece geometry. Tooling with more specific geometry can be used to obtain more specific geometry in the workpiece. FIG. 13 demonstrates how the forming body of this setup reflects its convex geometry, causing this ring to be concave on the inner surface.

Figure 2:
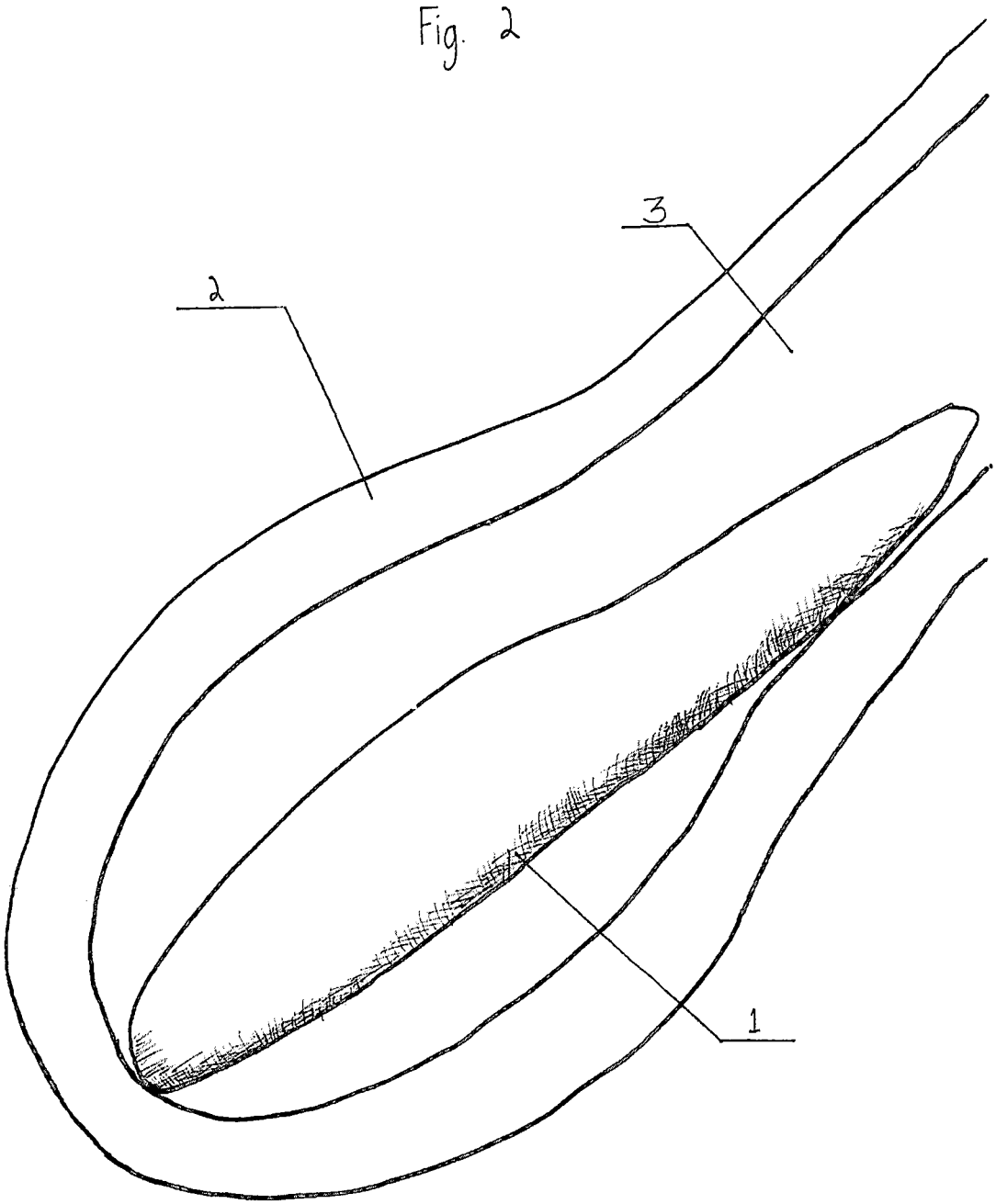
FIG. 2—This "crucible" is setup typical to forming metal.
Figure 3:
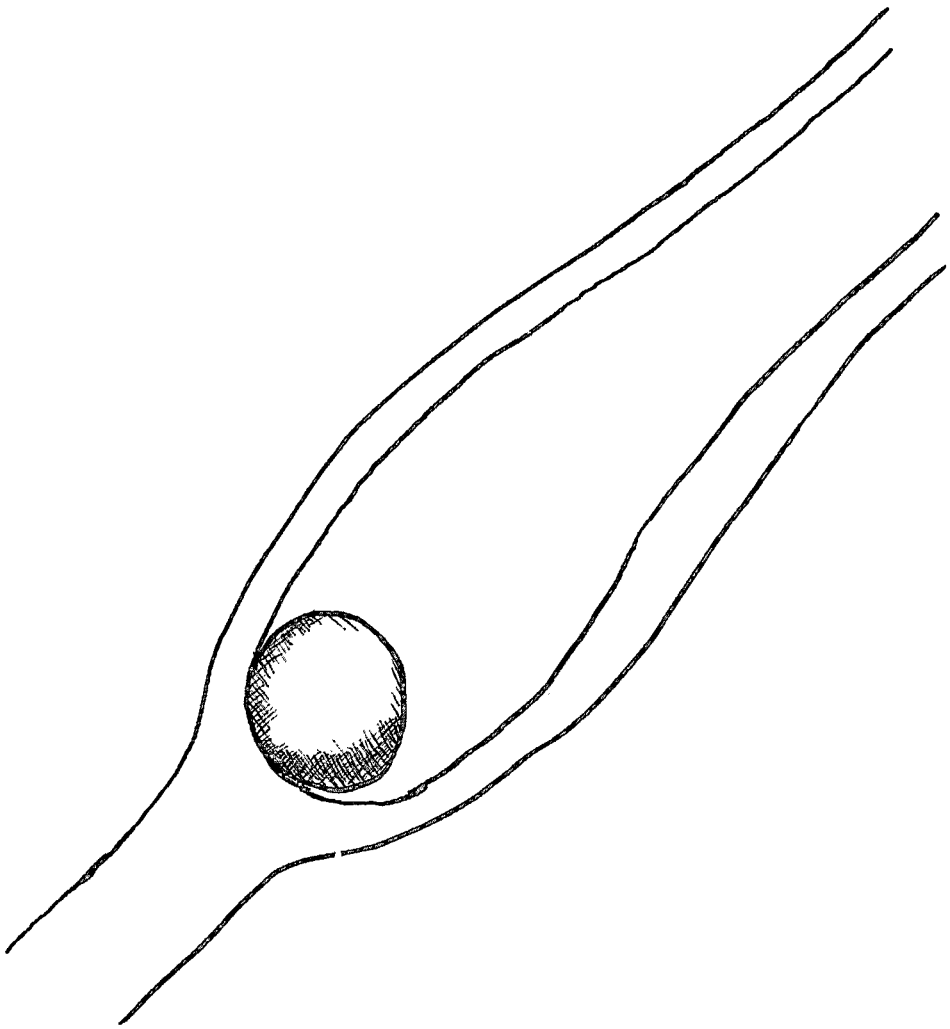
FIG. 3—During the encasement process it is helpful to use heat for multiple purposes. Primarily it is to melt the material to be formed, but this can be used to condense more of the tubing to assist with the setup.

The metal must first be encased in glass. Multiple methods of encasing the metal have been explored. In the present embodiment, encasement begins with a 12 mm diameter, 2.2 mm wall thickness borosilicate glass tube. FIG. 1 shows a typical pre-shaped crucible for melting the material to be formed. FIG. 1, element 1, shows a rod attached to the bottom to supply more glass and to act as a support for the sample that will be encased. FIG. 2 shows a similar encasement preshape with a 14 k gold forming blank inside (FIG. 2, element 1). The tube can be flied with an inert gas (FIG. 2, element 3) to prevent oxidation or another gas depending on the desired result. FIG. 3 shows the point in the process where the forming blank has melted but the crucible and tube have yet to reach a temperature where they become malleable and begin to collapse.

Figure 4:
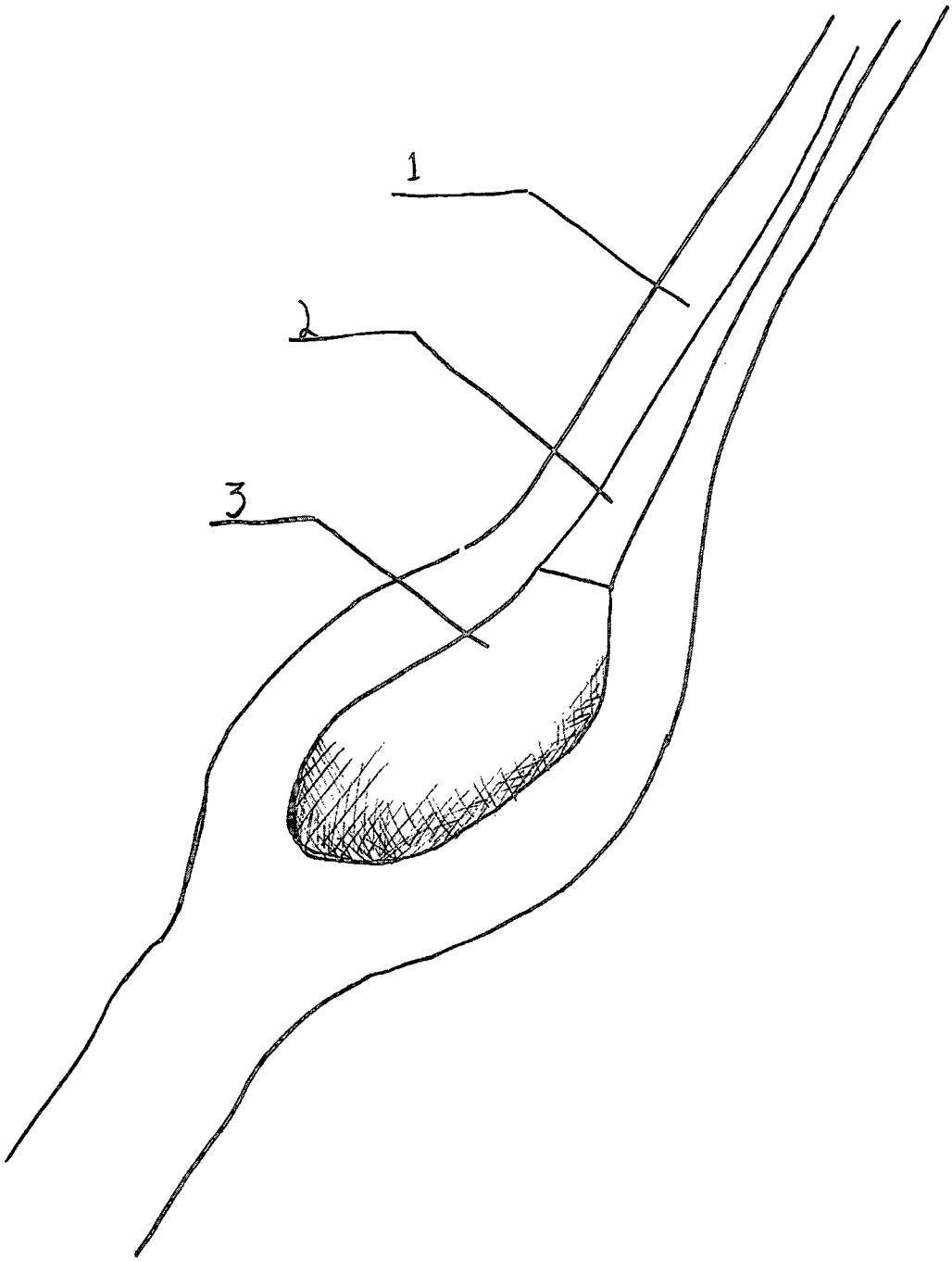
FIG. 4—As the crucible or tube begin to be stretched or condensed around the workpiece, the opening will continue to get smaller until it closes up. This part of the process is critical as trapped gas bubbles of any size can cause various issues.

As the whole forming system is spun to allow an even gravitational effect, any oxides or slag that form on the workpiece, typically stick or are absorbed into the glass. This is one part of the process where impurities are reduced. FIG. 4 shows the forming system as the forming medium (FIG. 4, element 1) becomes liquid and begins to collapse around the workpiece. It is important at this point to prevent bubbles from forming on the surface of the workpiece as they are difficult to remove later, and may create pits in the final geometry. In a separate embodiment, a method requires a glass furnace. A pool of molten glass is isolated from the furnace tank and a small divot is made on the surface. At the same time, the metal is melted in a crucible so that it can be poured into this divot. As the metal sinks, the glass flows and closes over the top of the metal.

Figure 5:
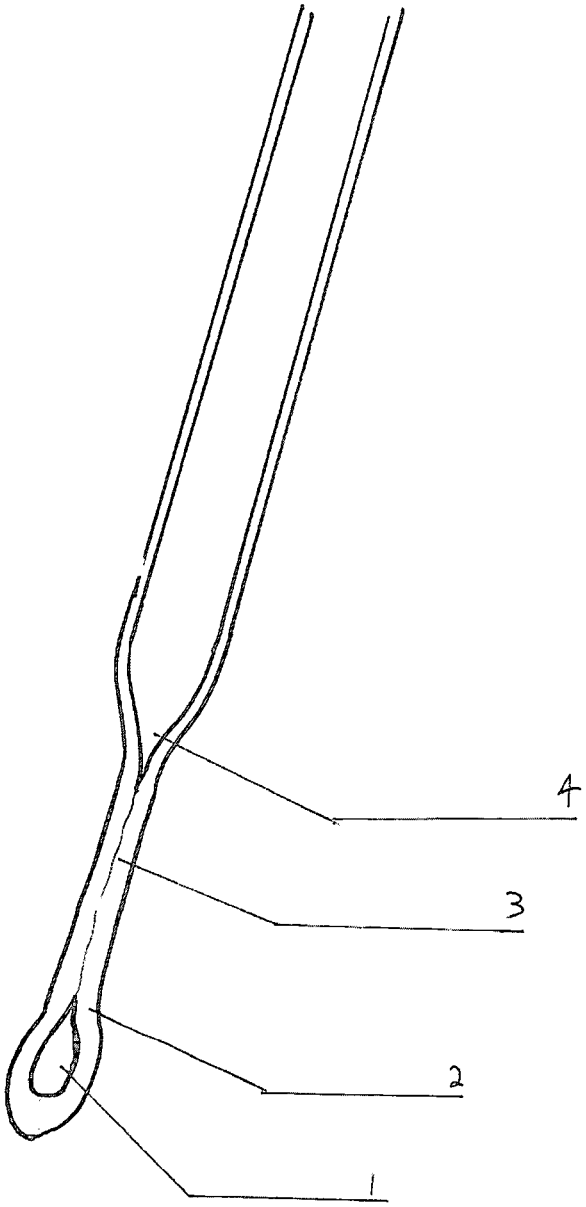
FIG. 5—A piece of silver is allowed to flow through the center of the glass to help with a dean encasement.

The thickness during encasement does not need to correlate with subsequent setup and forming operations. The primary desired qualities of metal encasement are a smooth, bubble-free, and oxide-free surface. FIG. 5 shows how gravity can be used to allow the workpiece (FIG. 5, element 1) to flow through the center of the forming medium (FIG. 5, element 2), leaving behind a trail of impurities (FIG. 5, element 3) that the forming medium absorbs. This part of the process can be used to get rid of surface bubbles or other unwanted defects.

Figure 6:
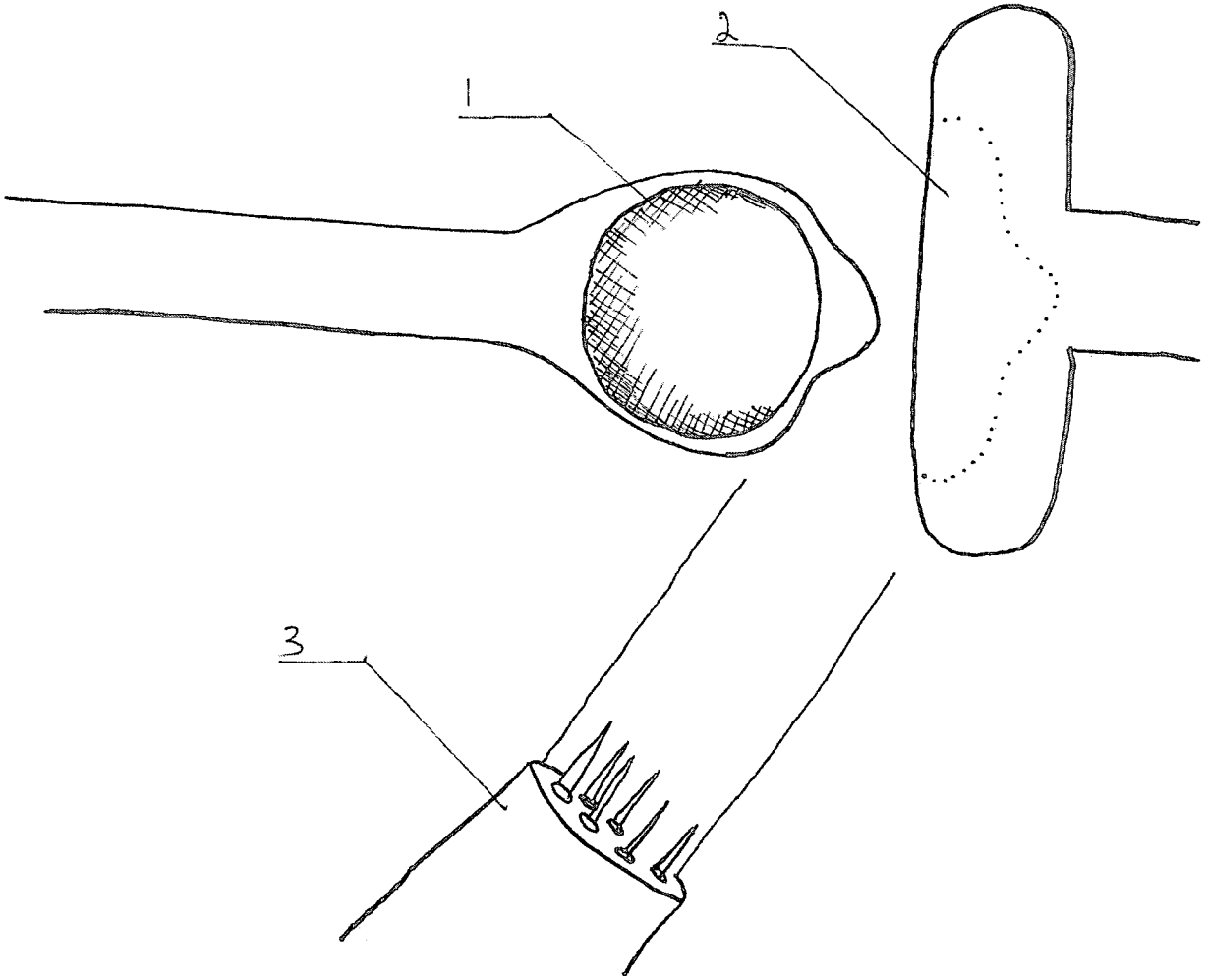
FIG. 6—Overlay method of applying mass to the setup. Prior to this setup operation's start, part 2 in this drawing is heated until it is soft. This will allow part 1 to be pushed into the glass in an effort to get the glass further up the sides.
Figure 7:
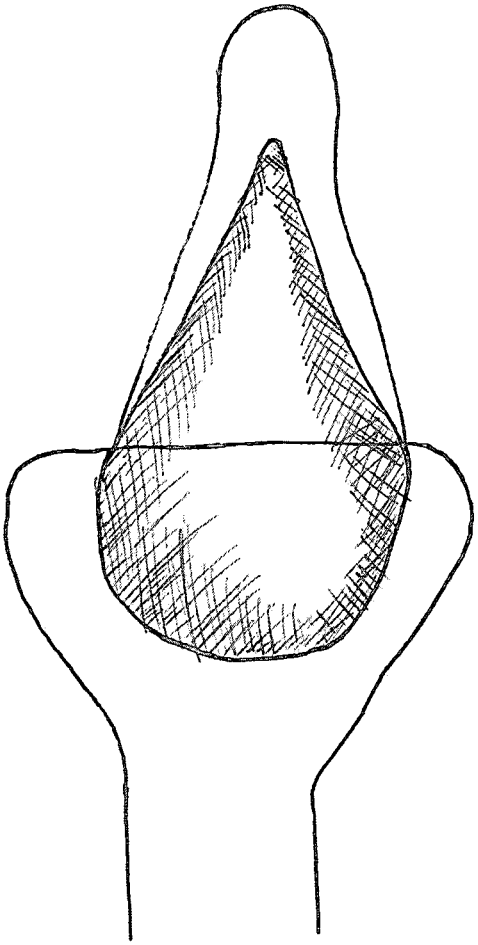
FIG. 7—The result of the setup operation described in FIG. 5. This workpiece now has an additional 2 mm of glass on one half.

Once the metal is fully encased in the glass, the set up for the forming operation takes place. This requires getting the proper thickness wound the sphere of metal as well as a proper heat base within the glass. Different forms and shapes will require varying thicknesses and amounts of heat within the mass of glass and metal. FIG. 6 shows the first step in a process that increases the glass thickness on one side of the workpiece. A disc of glass (FIG. 6, element 2) is heated on the face until soft. A colder, solid workpiece (FIG. 6, element 1) is pushed into the face of the additional disc of glass. This results in an object like the one shown in FIG. 7. The process is then repeated on the other side and the glass thickness is even on the entire surface of the workpiece.

Figure 8:
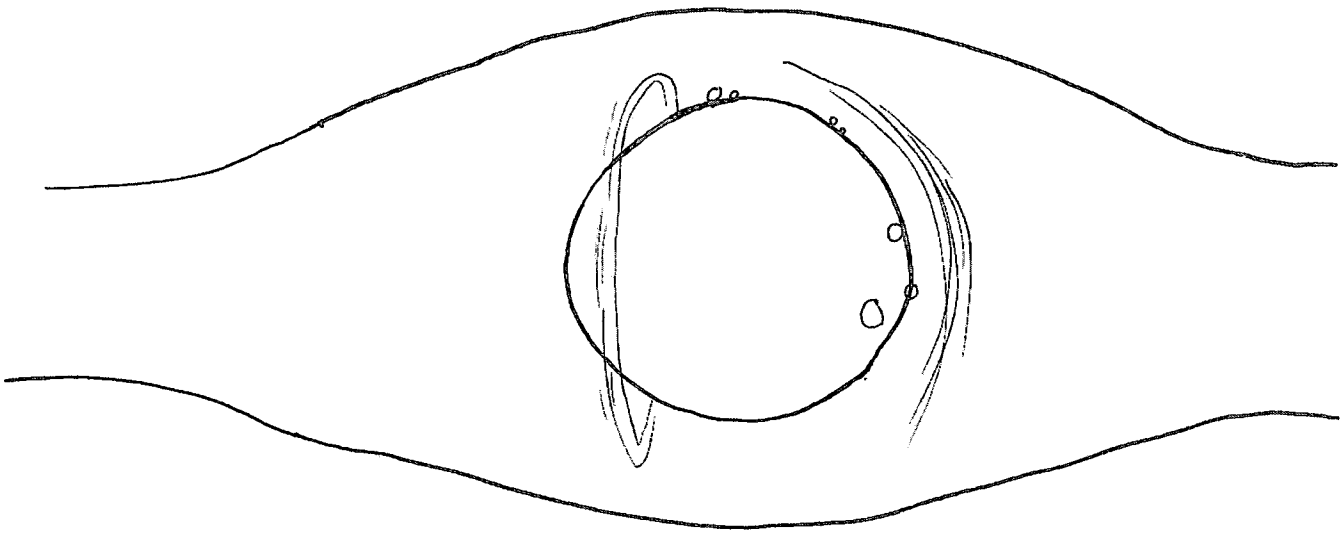
FIG. 8—Detail of an encasement showing some cords in the glass as well as some bubbles on the workpiece.
Figure 9:
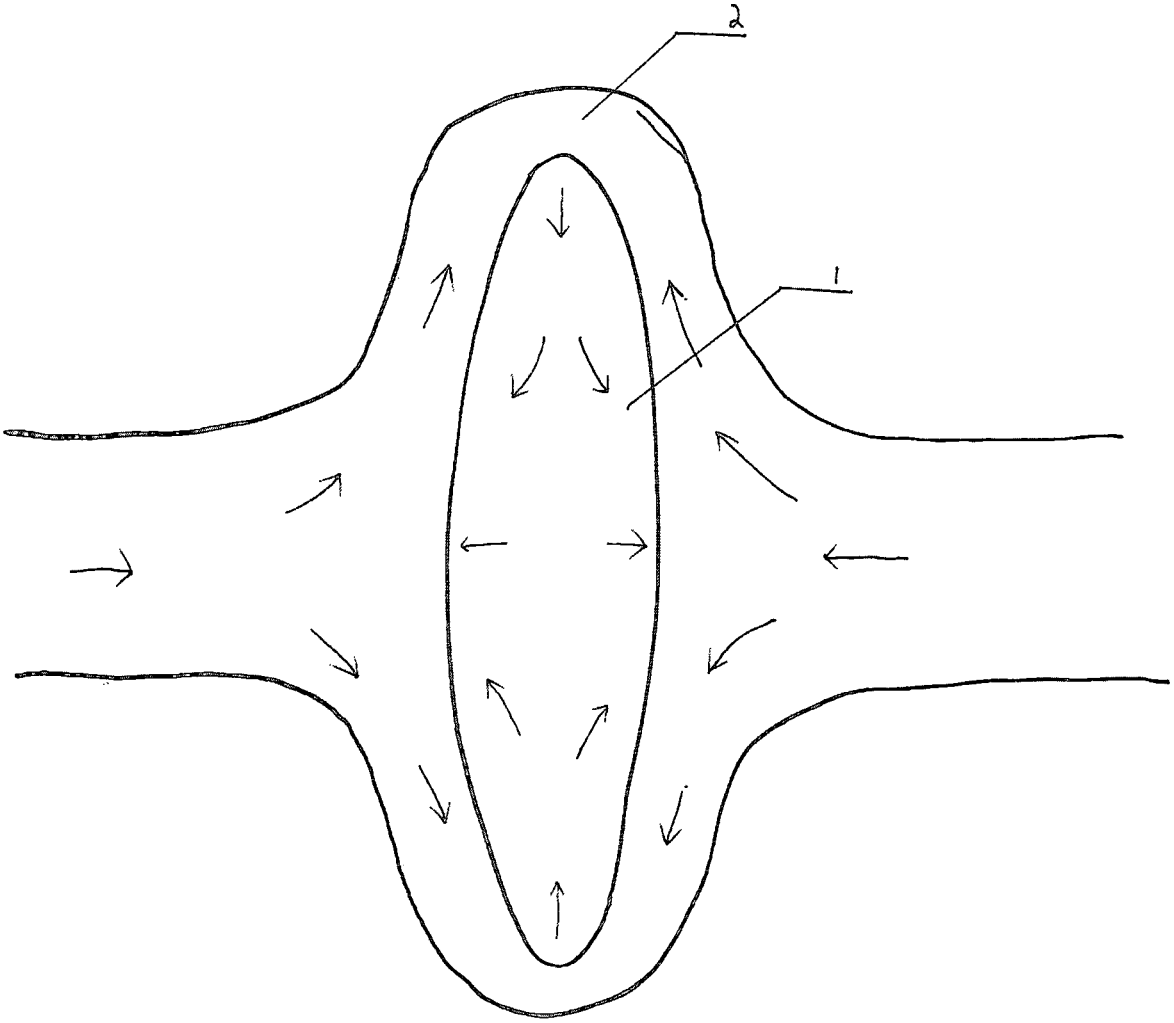
FIG. 9—Surface tension can be used to accumulate mass around a workpiece. The arrows in this diagram show the ways in which forces are moving material. As the metal tries to become a sphere, the glass being pushed towards the center flows to the outside and takes the space of the metal as it draws toward the center.

Most forming operations, whether singular or multistep will begin with a spherical shape (FIG. 8), largely due to the surface tension of the metal and its tendency to become a sphere. The setup or the addition and shaping of more glass around the workpiece will typically happen while the metal remains below its melting temperature. This allows more control of the glass thickness and shape without concern for unintentionally changing the shape of the workpiece. An exception to this is a technique which can be called, surface tension mass movement, illustrated in FIG. 9. As the two rods are slowly pushed together, the glass and metal are forced outward. Because of surface tension, the metal (FIG. 9, element 1) is drawn inward as it wants to become a sphere. This negative pressure is met with positive pressure from the glass (FIG. 9 element 2) and thickness is built up on the outside of the vitriform.

Figure 11:
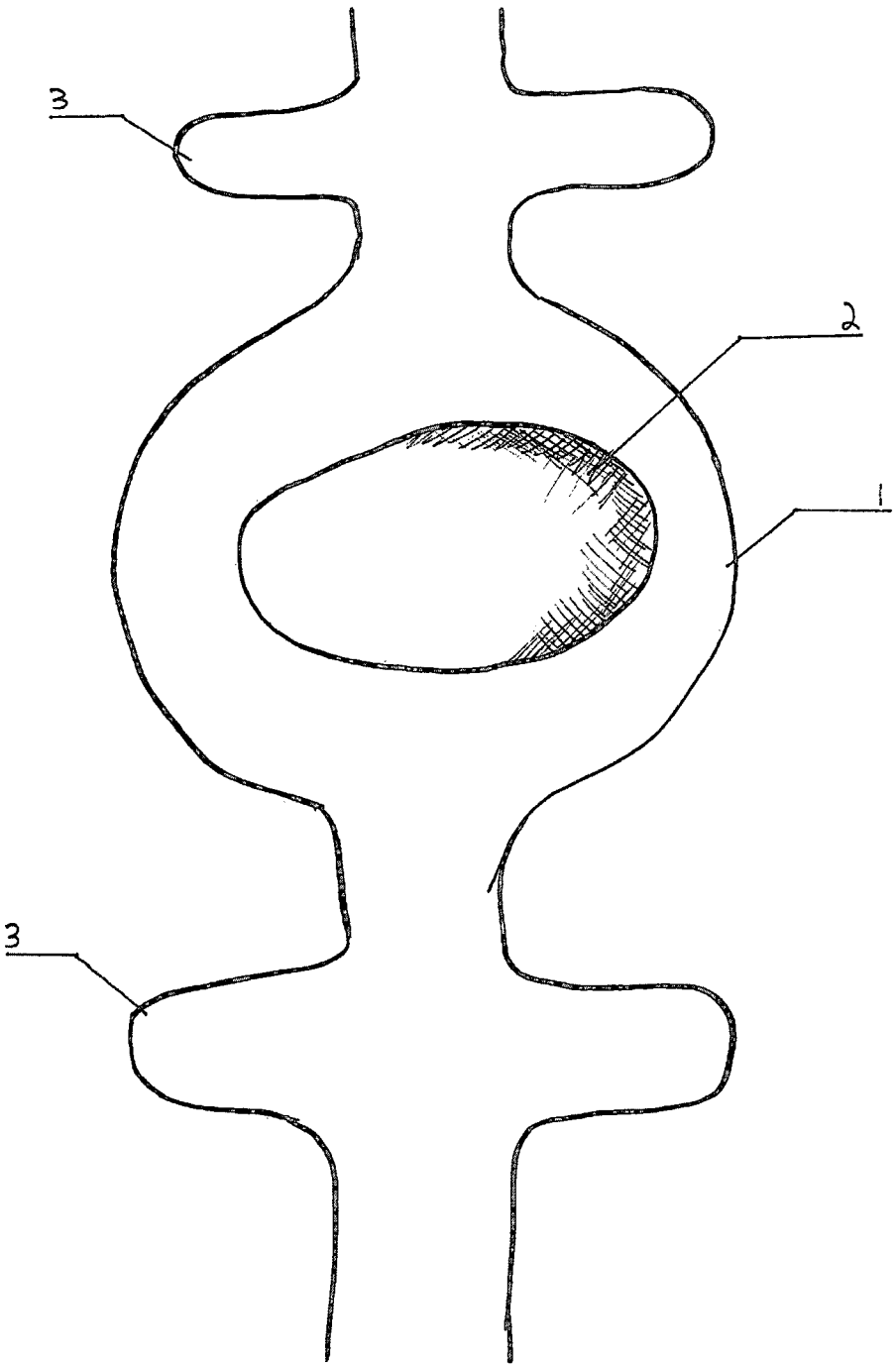
FIG. 11—This is a common setup for forming a ring. The diameter of parts 1 and 2 is roughly 13 mm. Part 1 and 2 will be heated until molten. Once the proper amount of heat is absorbed, parts 3 and 4, which are still stiff, are used to push through the center of the sphere, creating a ring. Parts 3 and 4 can be made with the shown geometry, or the proper diameter can be attained with the initial stock used for the handle.

Once the setup is complete, the forming takes place by manipulating the glass through an outside force. As the glass becomes malleable, it can be stretched or pushed using various conventional tools with differing geometries such as, graphite rods, paddles, surfaces, or specifically cut forming tools or molds. Metal tools can be used as well. The quid metal inside will be affected by these forces in relation to the thickness and viscosity of the glass. If properly planned and executed, repeatable and accurate, and complex 3-dimensional metal forms can be created. FIG. 11 shows a triangular shaped vitriform, created by pulling the glass in three directions. The forming tool (FIG. 11, element 4) adhered to the forming medium (FIG. 11, element 2) and was used to pull the workpiece in three directions, two handles were used as forming tools as well. An object like this would have a setup similar to that in FIG. 8.

Many different kinds of geometry can be achieved through this method. This depends on the type of tooling used and its geometry. The thickness of the forming medium is a determining factor as to what geometry is possible. The more thickness around the glass, the more the geometry is dependent on the fluid dynamics and interaction between the viscosities of the forming medium and workpiece. This results in hyperbolic geometry. Inversely, the thinner the forming medium, the tighter the tolerance can be in relation to the geometry of the tooling used. Through this approach, Euclidean geometry can be achieved, within a tolerance dependent on the various factors.

Figure 10:
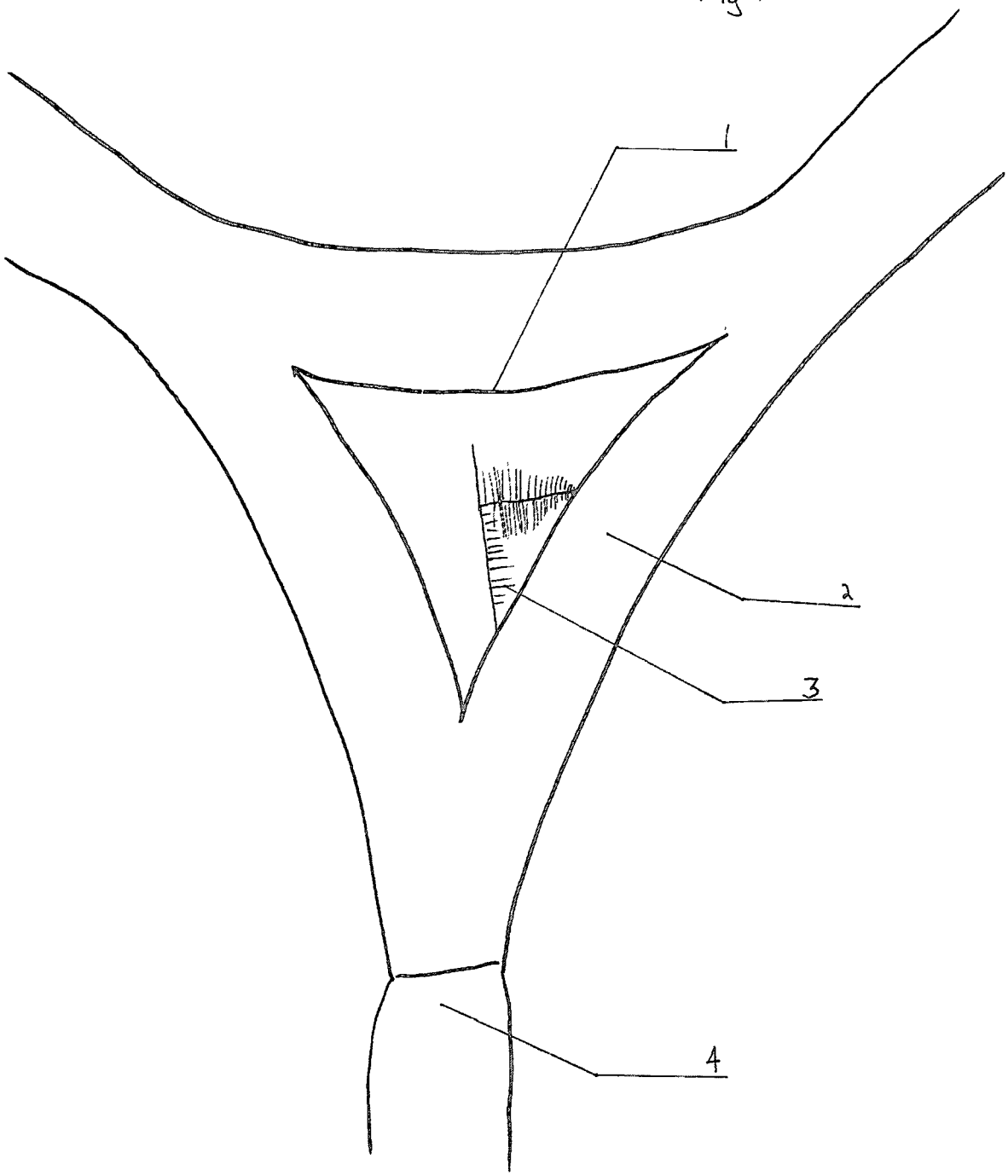
FIG. 10—This piece of metal formed into a triangle exhibits characteristic crystal structure formations on the surface.

The surface quality of objects made-using this process is also a unique and defining feature. The crystal structure of the metal becomes visible on the surface as it solidifies. This can be seen in FIG. 10. The example shown is a piece of 24 k gold inside of borosilicate glass. This is a result of solidification within an external fluid. If the workpiece is under negative pressure due to the stretching action of the forming medium and/or the shrinkage of the metal itself, the liquid metal will be pulled away fromthe surface as the crystals are forming within the metal. This action results in a surface texture that shows the spines of dendritic crystal formation in metal (FIG. 10 element 3). A unique result of this process is that the crystal structure and geometry are directly dependent on each other. As the forming takes place, areas that become thin or come into contact with a cold tool will begin to form seed crystals that will continue to grow as the forming medium and workpiece reach the solidification temperature of the metal. Through the use of specific heat variation and forming medium thickness, differing temperatures can be achieved in different areas of the vitriform, allowing for the control of its crystal structure.

In the present embodiment, rings are a common geometry that is formed. FIG. 11 shows one setup that is conducive to making rings. The workpiece (FIG. 11 element 2) is centered between two forming tools (FIG. 11 element 3 and 4). As the forming medium (FIG. 11, element 1) and the workpiece are heated, the forming tools are kept at a lower temperature. This allows them to be rigid and to impart geometry onto the workpiece. Once the center mass has reached the correct temperature, the two handles are used to push the forming tools into the center of the workpiece. This will create a hole in the workpiece.

Figure 12:
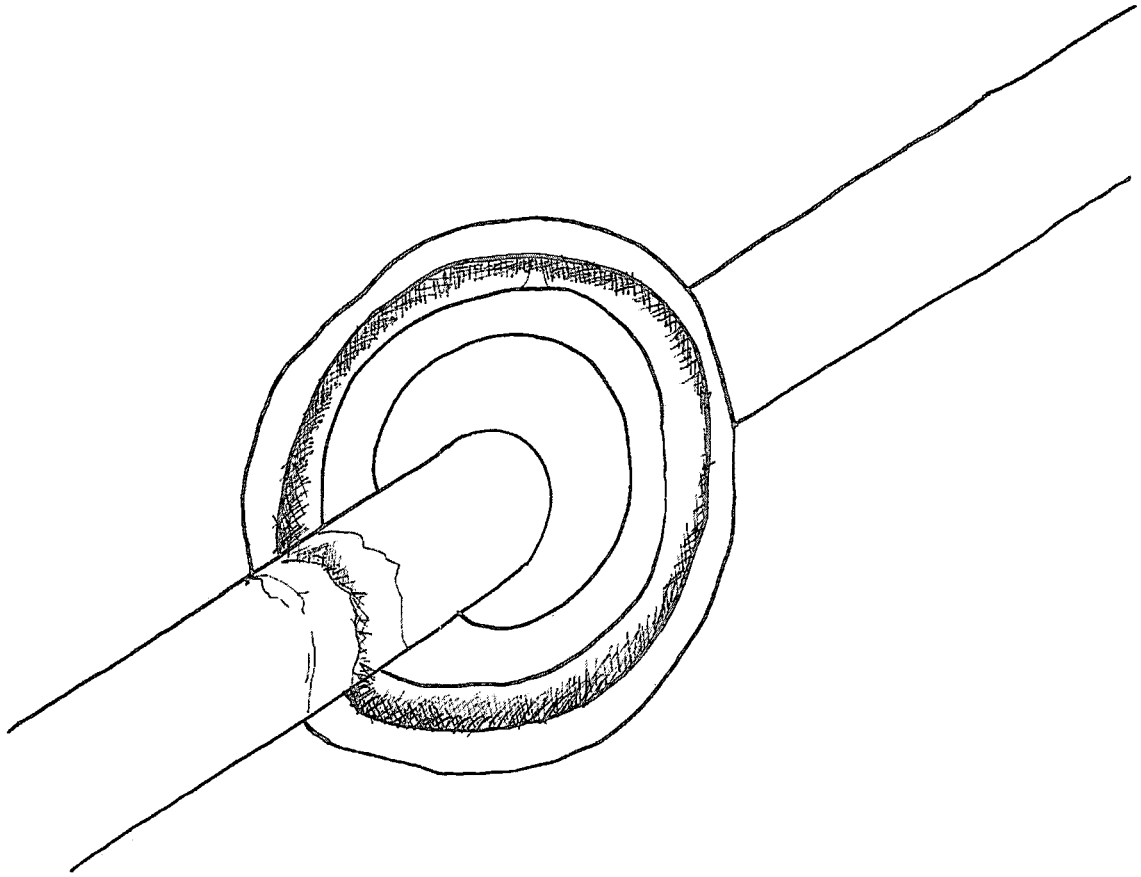
FIG. 12—Orthographic view of a ring after formation.

FIG. 12 is an orthographic view of a ring that has just been formed using this technique.

FIG. 13 demonstrates how the forming tool geometry is mirrored in the workpiece. As the convex forming tools (13.3) meet in the center, there is a concave ridge that is formed on the workpiece which can be seen as a cross section in FIG. 13, Section B-B. This can be counteracted in various ways but demonstrates that the forming tool geometry is what determines the workpieces final geometry.

Figure 14:
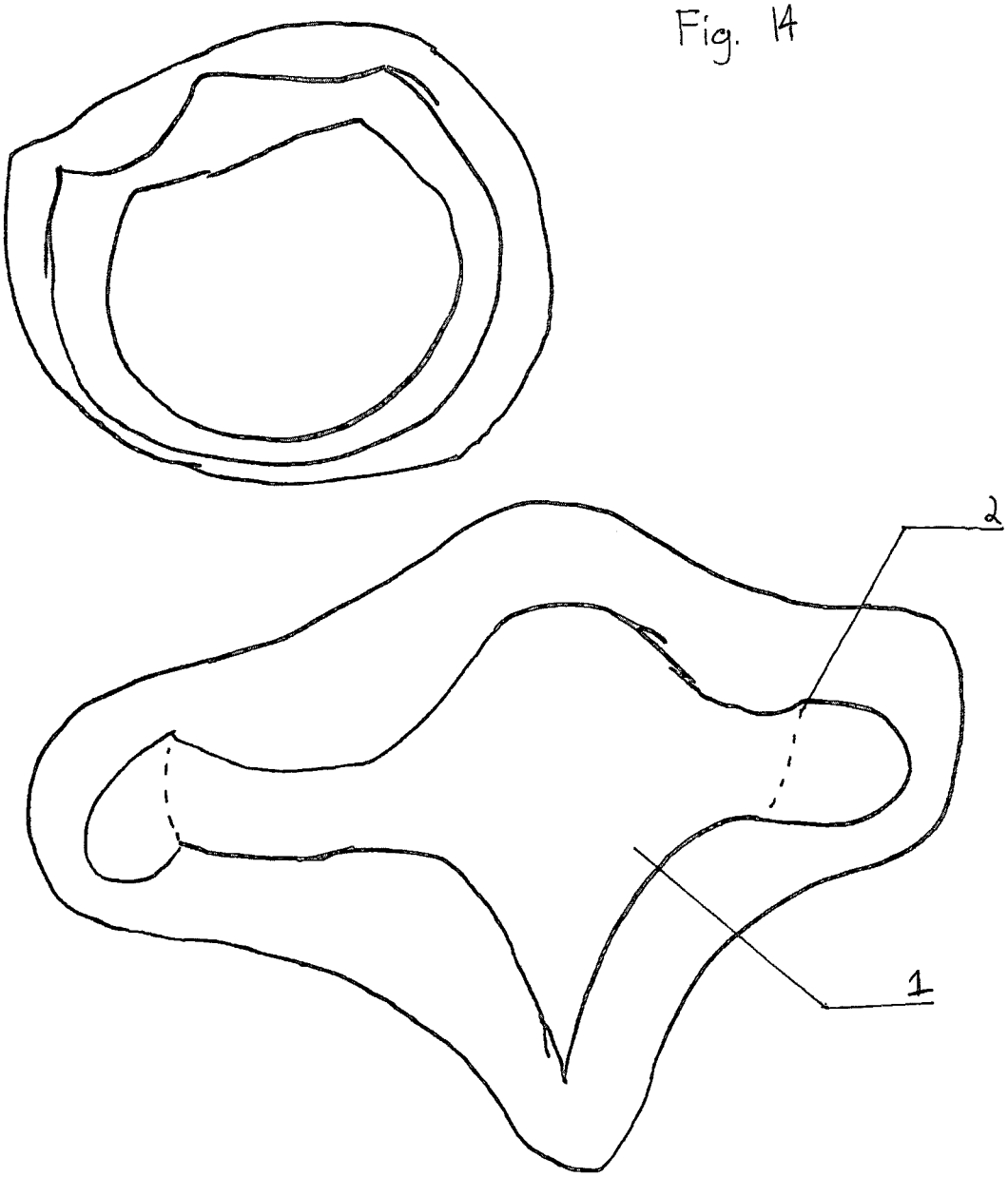
FIG. 14—This figure shows the results of a secondary forming operation. The area between the dotted lines is the specific section (1) of the workpiece that has been melted and formed a second time.

Forming operations can occur multiple times before reaching a final geometry. FIG. 14 shows a ring that has had a secondary forming operation. The ring was formed using the techniques described. Once the ring had been formed, a section (FIG. 14, element 1) was re-heated with a torch until the workpiece became partially molten. Two tools were used to stretch this molten section of the ring to create a new geometry. The geometry at the boundary between the molten and solid parts of the ring creates a ridge. (FIG. 14, element 2) This process can be repeated as many times as is required to reach the desired geometry.

Once the workpiece has been formed into its final geometry there are multiple different options available. Commonly this is the point of the process where extraction takes place. Alterative embodiments can include skipping extractions and using the forming medium or material Bas a component of the final object/assembly. This requires the material A and material B to be compatible in terms of shrinkage rates and chemistry. This ability to create integrated glass/metal assemblies is an aspect of this forming process that cannot be replicated another way.

Figure 15:
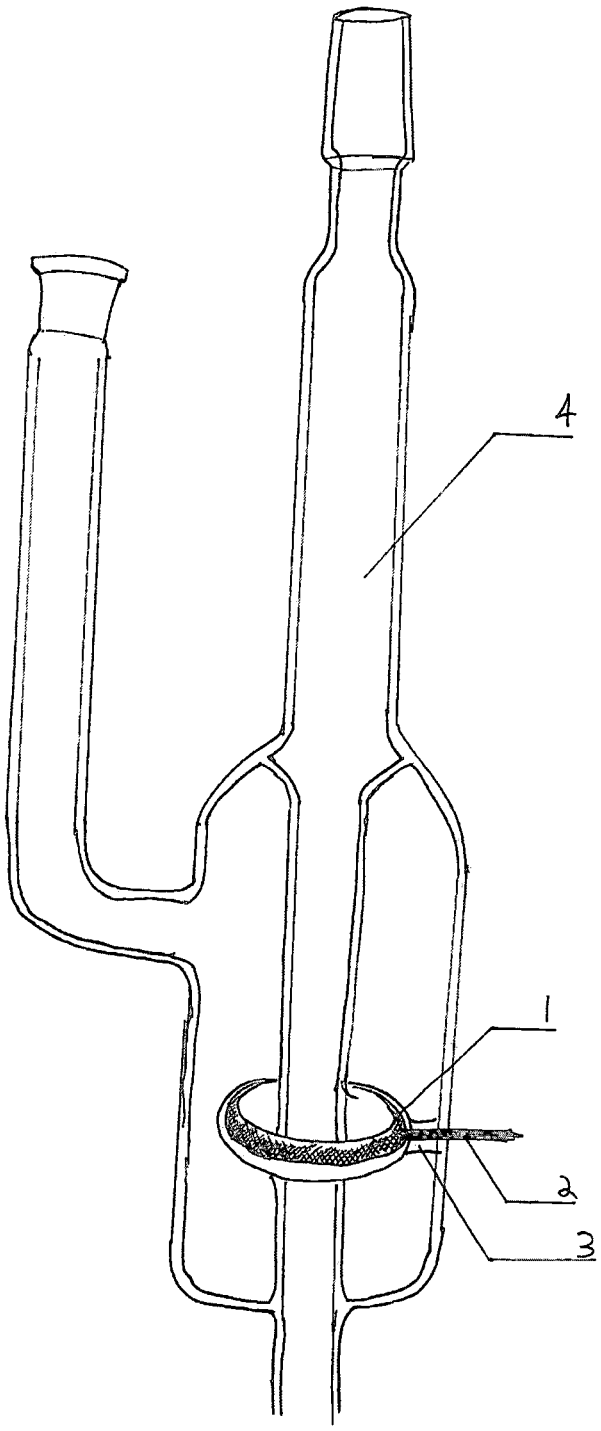
FIG. 15—This assembly uses a 24 k gold vitriformed ring (1), still encased in borosilicate glass. A tube goes through the center of the ring. There is also access through a hole drilled in the side. (2, 3)

FIG. 15 shows an apparatus that includes an example of a vitriformed assembly. This assembly, composed of hollow borosilicate glass tubes, also contained a vitriformed ring (FIG. 15, element 1). The center tube (FIG. 15, element 4) extends all the way through the assembly, going through the hollow center of the ring. A small amount of solid glass was sealed in between the outer wall and the vitriform (FIG. 15, element 3). This small solid connection allows for a hole be drilled from the outside to make contact with the metal of the ring. A conductive rod is inserted (FIG. 15 element 2) which allows for electrical access to the vitriform while still keeping the inside of the vessel sealed. Common scientific glassblowing techniques were used to assemble the vitriform and the contained apparatus.

One embodiment of this process includes the step of assembling multiple vitriformed parts prior to extraction. This allows for multiple types of metal to be used and combined as well as expands the geometric vocabulary possible using this process. This technique consists of forming an open hole in the forming medium of two workpieces, and subsequently sealing the two openings to each other. Once the forming medium has been attached and becomes one sealed envelope, the entire vitriform is heated until the workpiece melts and the two sections flow into each other. This effectively welds the two workpieces together into one.

Extraction is the final step of the process. The metal can be extracted from the glass through multiple different techniques. Repeated heating and quenching will cause the glass to fracture and eventually break off. If heat is used to induce stress, care must be taken to avoid oxidation on the surface of the workpiece. Mechanical force can be used to fracture the glass as well. Using mechanical force is risky as well because it becomes much easier to deform the geometry of the finished workpiece. The glass can be dissolved through chemical means. Some potentially viable chemicals to accomplish this are Sodium Hydroxide, Hydrofluoric Acid, or any other appropriately strong acid or base, depending on the type of glassy material used. However, this method is only useful if the glass solvent does not react with the material of the workpiece.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally" "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "Interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

Applicant reserves the right to physically incorporate into this specification any and all materials and information from any such patents, publications, scientific articles, web sites, electronically available information, and other referenced materials or documents to the extent such incorporated materials and information are not inconsistent with the description herein.

The written description portion of this patent includes all claims. Furthermore, all claims, including all original claims as well as all claims from any and all priority documents, are hereby incorporated by reference in their entirety into the written description portion of the specification, and Applicant(s) reserve the right to physically incorporate into the written description or any other portion of the application, any and all such claims. Thus, for example, under no circumstances may the patent be interpreted as allegedly not providing a written description for a claim on the assertion that the precise wording of the claim is not set forth in haec verba in written description portion of the patent.

The claims will be interpreted according to law. However, and notwithstanding the alleged or perceived ease or difficulty of interpreting any claim or portion thereof, under no circumstances may any adjustment or amendment of a claim or any portion thereof during prosecution of the application or applications leading to this patent be interpreted as having forfeited any right to any and all equivalents thereof that do not form a part of the prior art.

All of the features disclosed in this specification may be combined in any combination. Thus, unless expressly statnd otherwise, each feature disclosed is only an example of a generic series of equivalent or similar features.

It is to be understood that while the invention has been described in conjunction with the detailed description thereof, the foregoing description is intended to illustrate and not limit the scope of the invention, which is defined by the scope of the appended claims. Thus, from the foregoing, it will be appreciated that, although specific embodiments of the invention have been described herein for the purpose of illustration, various modifications may be made without deviating from the spirit and scope of the invention. Other aspects, advantages, and modifications are within the scope of the following claims and the present invention is not limited except as by the appended claims.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or Imitation or imitations, which is not specifically disclosed herein as essential. Thus, for example, in each instance herein, in embodiments or examples of the present invention, the terms "comprising, including", "containing", etc. are to be read expansively and without imitation. The methods and processes illustratively described herein suitably may be practiced in differing orders of steps, and that they are not necessarily restricted to the orders of steps indicated herein or in the claims.

The terms and expressions that have been employed are used as terms of description and not of Imitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention as defined by the appended claims.

The invention has been described broadly and generically herein. Each of the narrower species and sub-generic groupings falling within the generic disclosure also form part of the invention. This includesthe generic description of the invention with a proviso or negative limitation removing any subject matter from the genus, regardless of whether or not the excised material is specifically recited herein.

It is also to be understood that as used herein and in the appended claims, the singular forms "a," "an," and "the" include plural reference unless the context clearly dictates otherwise, the term "X and/or Y" means "X" or "Y" or both "X" and "Y", and the letter "s" following a noun designates both the plural and singular forms of that noun. In addition, where features or aspects of the invention are described in terms of Markush groups, it is intended and those sidled in the art will recognize that the invention embraces and is also thereby described in terms of any individual member or subgroup of members of the Markush group.

Other embodiments are within the following claims. Therefore, the patent may not be interpreted to be limited to the specific examples of embodiments or methods specifically and/or expressly disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

Other modifications and implementations will occur to those skilled the art without departing from the spirit and the scope of the invention as claimed. Accordingly, the description hereinabove is not intended to limit the invention, except as indicated in the appended claims.

What is claimed is:

1. A method of vitriforming materials, comprising the steps of:

encasing an amount of a material with an amount of a vitreous material to form a vitriform, wherein the vitreous material with a glass transition temperature;

using a heat source to increase a temperature of the encased material and the vitreous material such that the encased material becomes a liquid and the vitreous material passes the glass transition temperature of the vitreous material and wherein the material is molten; and using the vitreous material as a forming tool to contain and shape the material in a desired 3-dimensional geometry.

2. The method of claim 1, wherein, the material is a metal and the vitreous material is a glass.

3. The method of claim 1, wherein, the material is a non-metal.

4. The method of claim 1, wherein, the material and the vitreous material remain intact as an assembly.

5. The method of claim 4, wherein, the vitreous material is used as an electrolyte that electrically interacts with the material.

6. The method of claim 1, wherein, the interface between the material and the vitreous material is used to exchange atoms from the vitreous material to the material or form the material to the vitreous material.

7. The method of claim 6, whereby the molecules formed act as a release between the material and the vitreous material.

8. The method of claim 6, whereby the molecules formed act as an adherent between the material and the vitreous material.

9. The method of claim 6, whereby the molecules formed dissolve and remain a surface of the material and the vitreous material.

10. The method of claim 1, wherein, the forming toot consists of a non-glass such as metal, graphite, wood, or other rigid, temperature resistant materials.

11. The method of claim 1, wherein, the heat source is an inductive heater.

12. The method of claim 1, wherein, an oxygen-propane torch is used as the heat source.

13. The method of claim 1, wherein the method is further comprised of the steps of forming two vitriforms;

creating an opening in the vitreous materials;

attaching the two vitriforms together using the heat source to melt the two vitriforms such that the molten aerial of both sections melt together to become one body of molten material.

14. The method of claim 13, wherein, the materials of the workpiece in both sections is the same.

15. The method of claim 13, wherein, the materials of the workpiece in both sections is different.

16. The method of claim 1, wherein the forming tool consists of glass.

* * * * *